United States Patent [19]

Toya

[11] Patent Number: 4,916,049

[45] Date of Patent: Apr. 10, 1990

[54] SILVER HALIDE PHOTOGRAPHIC MATERIAL

[75] Inventor: Ichizo Toya, Kanagawa, Japan

[73] Assignee: Fuji Photo Film Co., Ltd., Kanagawa, Japan

[21] Appl. No.: 282,781

[22] Filed: Dec. 12, 1988

[30] Foreign Application Priority Data

Dec. 11, 1987 [JP] Japan ..... 62-313637

[51] Int. Cl.[4] ..... G03C 1/76

[52] U.S. Cl. ..... 430/531; 430/523; 430/627; 430/628; 430/639; 430/640; 430/641; 430/642

[58] Field of Search ..... 430/502, 523, 531, 627, 430/628, 639, 640, 641, 642, 911

[56] References Cited

U.S. PATENT DOCUMENTS

| | | | |
|---|---|---|---|
| 4,056,395 | 11/1977 | Sato et al. | 430/323 |
| 4,318,970 | 3/1982 | Kurland et al. | 430/523 |
| 4,585,730 | 4/1986 | Cho | 430/523 |
| 4,710,456 | 12/1987 | Naoi et al. | 430/628 |

*Primary Examiner*—Hoa Van Le

*Attorney, Agent, or Firm*—Sughrue, Mion, Zinn, Macpeak & Seas

[57] ABSTRACT

A silver halide photographic material is disclosed, comprising a support having at least two hydrophilic colloid layers on one side of a support, at least one of said hydrophilic colloid layers containing dextran having an average molecular weight of at least 100,000, wherein at least one hydrophilic colloid layer containing substantially no dextran and having a dry thickness of at least 1.0 μm exists between the hydrophilic colloid layer containing the dextran disposing nearest to the support and the support.

11 Claims, No Drawings

SILVER HALIDE PHOTOGRAPHIC MATERIAL

FIELD OF THE INVENTION

This invention relates to a silver halide photographic material (hereinafter, is referred to as a photographic light-sensitive material or a photographic material), and more particularly to a photographic light-sensitive material having improved sensitivity with good adhesion between a subbing layer and a silver halide photographic emulsion layer (hereinafter, is referred to as a photographic emulsion layer or an emulsion layer).

BACKGROUND OF THE INVENTION

The increase in sensitivity of photographic light-sensitive materials is of key importance to manufacturers of photographic emulsions.

Various additives are commonly used for increasing the sensitivity of a silver halide photographic emulsion. These additives mainly comprise synthetic polymers and saccharides. Typical examples of these synthetic polymers include the polyacrylamides disclosed in U.S. Pat. Nos. 3,271,158 and 3,514,289. Also, typical examples of the saccharide include dextran as disclosed in U.S. Pat. No. 3,063,838, 3,272,631, etc.

However, when these additives are used in an amount sufficient to achieve their intended purpose, the photographic emulsion layer(s) tend to peel off from the subbing layer. Subbing layers are formed for enhancing adhesion of the photographic emulsion layer(s) to a support during photographic processing.

Photographic lightsensitive materials which tend to peel have greatly reduced commercial value.

As a method of preventing peeling of the photographic emulsion layer during photographic processing, it has been proposed in JP-A-61-69061 (the term "JP-A" as used herein means an "unexamined published Japanese patent application") which involves controling the ratio of dextran to a binder in the photographic emulsion layer. However, this technique used alone does not completely prevent peeling of the photographic emulsion layer.

SUMMARY OF THE INVENTION

An object of the present invention is, therefore, to provide a photographic light-sensitive material having improved sensitivity and having a photographic emulsion that does not tend to peel-off.

This objective is attained by the present invention as described below.

The present invention provide a silver halide photographic material comprising a support having at least two hydrophilic colloid layers on one surface of a support, at least one of said hydrophilic colloid layers containing dextran having an average molecular weight of at least 10,000, wherein at least one hydrophilic colloid layer containing no dextran and having a dry thickness of at least from 1.0 μm exists between the hydrophilic colloid layer containing the dextran disposing nearest to the support and the support.

DETAILED DESCRIPTION OF THE INVENTION

In the present invention, the aforesaid hydrophilic colloid layer containing substantially no dextran preferably contains no silver halide photographic emulsion.

Typical example of layer construction of a silver halide photographic material are shown below.

Embodiment 1:

The silver halide photographic material have (1) a light-insensitive hydrophilic colloid layer containing substantially no dextran and having a dry thickness of at least 1.0 μm, (2) a light-sensitive silver halide emulsion layer containing the dextran and (3) a surface protective layer on a support having a subbing layer in that order, and a backing layer at the opposite side of the support to the aforesaid side.

Embodiment 2:

The silver halide photographic material have (1) plural light-insensitive hydrophilic colloid layers containing substantially no dextran and having a dry thickness of at least 1.0 μm, (2) plural light-sensitive silver halide emulsion layers containing the dextran and (3) two surface protective layers on a support having a subbing layer in that order, and a backing layer at the opposite side of the support to the aforesaid side.

Embodiment 3:

The silver halide photographic material have (1) a light-insensitive hydrophilic colloid layer containing substantially no dextran and having a dry thickness of at least 1.0 μm, (2) a light-insensitive hydrophilic colloid layer containing the dextran, (3) plural light-sensitive silver halide emulsion layers containing the dextran and (4) a surface protective layer on a support having a subbing layer in that order, and a backing layer at the opposite side of the support to the aforesaid side.

Embodiment 4:

The silver halide photographic material have (1) a light-insensitive hydrophilic colloid layer containing substantially no dextran and having a dry thickness of at least 1.0 μm, (2) a light-sensitive silver halide emulsion layer containing the dextran and (3) a surface protective layer at both sides of a support in that order.

Embodiment 5:

The silver halide photographic material have (1) a light-sensitive silver halide emulsion layer containing substantially no dextran and having a dry thickness of at least 1.0 μm, (2) a light-sensitive silver halide emulsion layer containing the dextran and (3) a surface protective layer on a support having a subbing layer in that order, and a backing layer at the opposite side of the support to the aforesaid side.

Typical examples of the support for the photographic light-sensitive material of the present invention include cellulose nitrate films, cellulose acetate film, polyvinylacetal films, polystyrene films polyethylene terephthalate film, polyester films, papers, glass sheets, metal sheets, wood plates, etc.

In the present invention, dextran is preferably incorporated in the photographic emulsion layer(s).

The weight average molecular weight ($\overline{M}w$) of the dextran used in the present invention is at least 100,000, preferably from 120,000 to 200,000, and particularly preferably from 120,000 to 180,000. The amount of such a dextran to be added may vary, but the optimum amount thereof depends on the kind of photographic emulsion employed.

The dextran which is added to the photographic emulsion layer of the present invention is obtained by lowering the molecular weight of a native dextran by a partial decomposition polymerization method using an acid, an alkali, or an enzyme. The native dextran is obtained by reacting a dextran producing bacteria such as leuconostock, mesenteleudies, etc. , or a dextran succhrase separated from the cultivated liquid of the bacterial with a sucrose solution.

The addition amount of dextran of the present invention is preferably from 5 to 50% by weight and more preferably from 5 to 30% by weight, of the total binder including dextran in the layer to which the dextran is added.

The thickness of the layer (hydrophilic colloid layer) to which the dextran is added is preferrably 3 $g/m^2$ or more.

When dextran is added to a photographic emulsion, the dextran may be added thereto at any time but it is proper to add the dextran from after the 2nd ripening to before coating the emulsion.

Dextran may be added to a photographic emulsion as a power but it is preferable to add dextran as an aqueous 5 to 30 wt % solution thereof.

The aforesaid hydrophilic colloid layer containing substantially no dextran for use in this invention is preferably disposed adjacent to a subbing layer for support. The term "containing substantially no dextran" means that the hydrophilic colloid layer contains less than 5% by weight per the total binder contained in the layer.

The dry thicknes of the layer which does not substantially contain dextran is preferably from 1.0 μm to 5.0 μm, and more preferably from 1.0 μm to 3.0 μm. If the thickness thereof is less than 1.0 μm, it is necessary to prevent the diffusion of low molecular weight components of dextran from the upper layer(s) containing dextran to the subbing layer otherwise the adhesion between the hydrophilic colloid layer which does not substantially contain dextran and the subbing layer is reduced.

If the molecular weight of the dextran used in the present invention is too large, the sensitizing effect for photographic emulsion is undesirably not remarkable, while if the molecular weight thereof is too small, the adhesion between the emulsion layer and the subbing layer may be reduced.

The silver halide photographic material of the present invention is described as follows:

The silver halide grains used for the silver halide photographic emulsions of the present invention may have a regular crystal form such as cubic, octahedral, etc., an irregular crystal form such as spherical, tabular, etc., or a composite form of these crystal forms. Furthermore, the silver halide grains may be composed of a mixture of grains having various crystal forms.

The photographic emulsion for use in the present invention can be prepared by the methods described in P. Glafkides, *Chemie et Phisique Photographique*, published by Paul Montel Co.; G. F. Duffin, *Photographic Emulsion Chemistry*, published by the Focal Press, 1966; and V. L. Zelikman et al, *Making and Coating Photographic Emulsion*, published by The Focal Press, 1964. The photographic emulsion can be prepared by an acid method, a nuetralization method, an ammonia method, etc. Also, as a system of reacting a soluble silver salt and a soluble halide, a single jet method, a double jet method, or a combination thereof can be used.

Binders for the photographic layers of the photographic light-sensitive materials of the present invention include proteins such as gelatin, casein, etc.; cellulose compounds such as carboxymethyl cellulose, hydroxyethyl cellulose, etc.; saccharides such as agar-agar, sodium alginte, starch derivatives, etc.; and synthetic hydrophilic colloids such as polyvinyl alcohol, poly-N-vinylpyrrolidone, polyacrylic acid copolymers and the derivatives or the partial decomposition products thereof.

Gelatin for use in the present invention generally refers to a limed gelatin, an acid-treated gelatin, and an enzyme-treated gelatin. Gelatin containing high molecular weight components as described in JP-B-62-87952 is preferred.

Also, the photographic light-sensitive layers of the present invention can contain an alkyl acrylate series latex as described in U.S. Pat. No. 3,411,911 and 3,411,912, and JP-B-45-5331(the term "JP-B" as used herein means an "examined Japanese patent publication).

The silver halide emulsion for use in the present invention may be a premitive emulsion which is not chemically sensitized. For chemical sensitization, the methods described in P. Glafkides, *Chemie et Phisque Photographique* and V. L. Zelikman et al, *Making and Coating Photographic Emulsion* described above as well as H. Frieser, *Die Grundlagen der Photographischen Prozesse mit Silberhalogeniden*, published by Akademische Verlagsgesellschaft, 1968 can be used.

Sensitization mothods for use in the present invention include sulfur sensitization using a sulfur-containing compound capable of reacting with silver ions or active gelatin, reduction sensitization using a reducing material, and a noble metal sensitization method using a gold compound or a compound of other noble metal. These sensitization can be used alone or in combination.

More specifically, for the sulfur sensitization method, thiosulfates, thioureas, thiazoles, rhodanines, etc, can be used and specific examples of them are described in U.S. Pat. No. 1,574,944, 2,410,689, 2,278,947, 2,728,668, and 3,565,955. For the reduction sensitization method, stannous salts, amines, hydrazine derivatives, formamizinesulfinic acid, silane compounds, etc., can be used. Also for the noble metal sensitization methods, gold complex salts as well as complex salts of metals belonging to group VIII of the periodic table, such as platinum, iridium, palladium, etc., can be used.

The photographic light-sensitive materials of the present invention can contain various compounds such as antifoggants and stabilizers. Examples of such antifoggants and stabilizers include azoles such as benzothiazolium salts, nitroindazoles, triazoles, benzotriazoles, benzimidazoles (in particular, nitro-substituted products or halogensubstituted products), etc.; heterocyclic mercapto compounds such as mercaptothiazoles, mercaptobenzothiazoles, mercarptobenzimidazoles, mercaptothiadiazoles, mercaptotetrazoles (in particular, 1-phenyl-5-mercaptotetrazole), mercaptopyridines, etc.; the aforesaid heterocyclic mercaptocompounds having a water solubilizing group such as carboxy group and a sulfon group; thioketo compounds such as oxazolinethione, etc.; azaindenes such as tetraazaindenes (in particular, 4hydroxy-substituted (1,2,3*a*, 7)-tetraazaindenes), etc.; benzenethiosulfonic acids; and benzenesulfinic acids.

Detailed specific examples of antifoggants and stabilizers and methods for using them are described in U.S. Pat. No. 3,954,474, 3,982,947, and 4,021,248 and JP-B-52-28660.

The photographic light-sensitive layers of the present invention can contain a hardening agent. Specific examples of the hardening agent for use in the present invention are aldehyde series compounds such as mucochloric acid, formaldehyde, dimethylolurea, glyoxal, succinaldehyde, glutaraldehyde, etc.; active vinyl compounds such as divinylsulfone, methylenebismaleinimide, 5-acetyl-1,3-diacryloyl-hexahydro-s-triazine, 1,3,5-triacryloyl-hexahydro-s-triazine, 1,3,5-trivinylsulfonyl-hexahydro-s-triazine, 1,3-bis(vinylsulfonylmethyl)ether, 1,3,-bis(vinylsulfonyl) propanol-2, bis(α-vinylsulfonylacetamido)ethane, bis(vinylsulfony)-methane, etc.; active halogen series compounds such as 2,4-dichloro-6-hydroxy-s-triazine-sodium salt, etc.; N-carbamoylpyridinium salts as (1-morpholinocarbonyl-3-pyridinio)methane sulfonate, etc.; haloamidinium salts such as 1-(1-chloro-1-pyridinomethylene)-pyrrolidinium, 2-naphthalenesulfonate, etc.; and inorganic compounds such as chromium alum, etc.

The photographic light-sensitive materials of the present invention may further contain, in the photographic emulsion layers and/or other layers, various surface active agents for use as coating aids, as antistatic agents for improvement of sliding properties, for improvement of emulsification and dispersibility, for prevention of adhesion, and for improvement of photographic characteristics (e.g., development acceleration, increase of contrast, increase of sensitivity, etc.).

Surface active agents include nonionic surface active agents such as saponine (steroid series), alkylene oxide derivatives (e.g., polyethylene glycol, a polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide adducts of silicone), glycidol derivatives (e.g., alkenylsuccinic acid polyglyceride and alkyphenol polyglyceride), fatty acid esters of polyhydric alcohol, alkylesters of saccharide anionic surface active agents containing an acid group such as a carboxy group, a sulfo group, a phospho group, a sulfuric acid ester group, a phosphoric acid ester group, etc., (e.g., alkylcarboxylates, alkylsulfonates, alkylbenzenesulfonates, alkylnaphthalenesulfonates, alkylsurfuric acid esters, alkylphosphoric acid esters, N-acyl-N-alkyltaurines, sulfosuccinic acid esters, sulfoalkylpolyoxyethylene alkylphenyl ethers, and polyoxyethylene alkylphosphoric acid esters), etc.; amphoteric surface active agents such as aminoacids, aminoalkylsulfonic acids, aminoalkylsulfuric acid esters, aminoalkylphosphoric acid esters, alkylbetaines, amine oxides, etc.; and cationic surface active agents such as alkylamine salts, aliphatic quaternary ammonium salts, aromatic quaternary ammonium salts, heterocyclic quaternary ammonium salts (e.g., pyridiniums and imidazoliums), and phosphonium or sulfonium salts containing an aliphatic ring or a heterocyclic ring.

The photographic emulsions for use in the present invention may be spectrally sensitized by methine dyes, etc. The dyes which are thus used include cyanine dyes, merocyanine dyes, complex cyanine dyes, complex merocyanine dyes, holopolar cyanine dyes, hemicyanine dyes, styryl dyes, and hemioxonol dyes. Particularly useful are the cyanine dyes, merocyanine dyes, and complex merocyanine dyes.

Nuclei ordinarily utilized for cyanine dyes such as basic heterocyclic nuclei can be applied to these dyes. These include; pyrroline nuclei, oxazoline nuclei, thiazoline nuclei, pyrrole nuclei, oxazole nuclei, thiazole nuclei, selenazole nuclei, imiazole nuclei, tetrazole nuclei, pyridine nuclei, etc.; nuclei formed by fusing an aliphatic hydrocarbon ring to the aforesaid nuclei, and the nuclei formed by fusing an aromatic hydrocarbon ring to the aforesaid nuclei , such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied for the dyes described above. Carbon atoms on these nuclei may be substituted.

For merocyanine dyes or complex merocyanine dyes, 5membered or 6-membered heterocyclic nuclei may be applied such as pyrazolin-5-one nuclei, thiohydantoin nuclei, 2-thiooxazolidone-2,4-dione nuclei, thiazolidine-2,4-dione nuclei, rhodanine nuclei, thiobarbituric acid nuclei, etc., as a nucleus having a ketomethylene structure.

The present invention is illustrated in more detailed with reference to the following examples, although the present invention is not limited thereto.

Example 1

(1) Preparation of Light-Sensitive Silver Halide Emulsion:

An aqueous solution of potassium bromide and potassium iodide and an aqueous solution of silver nitrate were simultaneously added to an aqueous gelatin solution with vigorous stirring to provide a silver halide emulsion containing thick tabular silver iodobromide grains (average iodine content of 10 mol %) having an average grain size of 1 μm. Thereafter, the emulsion was washed with water by an ordinary precipitation method and after adding thereto Dye−1 as shown below, the emulsion was chemically sensitized by a gold and sulfur sensitization method using chloroauric acid and sodium thiosulfate to provide a light-sensitive silver iodobromide emulsion A.

By following the same procedure as above while controlling the amount of poatassium iodide and the temperature for preparing the emulsion, thick tabular silver halide emulsion B (average iodine content of 6 mol %) or thick tabular silver halide emulsion C (average iodine content of 10 mol %) each having a mean silver halide grain size of 0.7 μm was prepared.

(2) Preparation of Coated Sample:

Each of Samples 1 to 11 was prepared by simultaneously forming the following layers on a triacetyl cellulose support having a subbing layer in this order.

Lowermost Layer

Binder: Gelatin 1 (shown below) 1 g/m$^2$

Coating Aid: Potassium Poly-p-styrenesulfonate 10.0 mg/m$^2$

Binder Layer

Surface Active Agent:

| | |
|---|---|
| Lowermost Layer | |
| Binder: Gelatin 1 (shown below) | 1 g/m$^2$ |
| Coating Aid: Potassium Poly-p-styrenesulfonate | 10.0 mg/m$^2$ |
| Binder Layer | |

-continued

| | |
|---|---|
| Surface Active Agent: 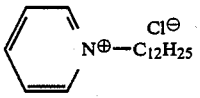 | 6 mg/m$^2$ |
| Binder: Gelatin 1 (shown below) | 1 g/m$^2$ |
| Fixing Accelerator: E - 1 (shown below) | 0.16 g/m$^2$ |
| Dye 8 (shown below) | 24 mg/m$^2$ |
| Dye 27 (shown below) | 15 mg/m$^2$ |

Dye 8

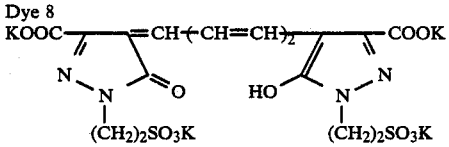

Dye 27

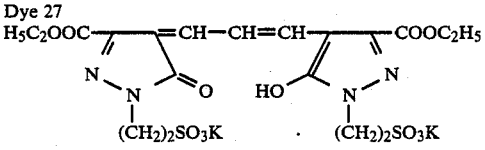

E-1

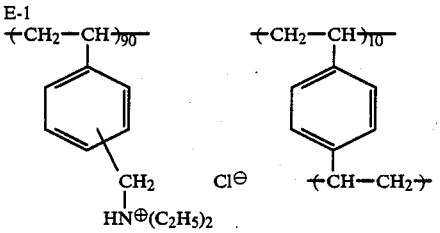

| | |
|---|---|
| Interlayer | |
| Binder: Gelatin 1 (shown below) | 0.4 g/m$^2$ |
| Coating Aid: Potassium Poly-p-styrene-sulfonate | 3.3 mg/m$^2$ |
| Emulsion Layer 1 | |
| Emulsion B | 1.5 g/m$^2$ as silver |
| Binder: Gelatin 2 (shown below) | 2 g/m$^2$ |
| Sensitizing Dye: Dye 1 (shown below) | 2.1 mg/lg-Ag |
| Additive: $C_{18}H_{35}O(CH_2CH_2O)_{20}H$ | 5.8 mg/lg-Ag |
| Coating Aid: Potassium Poly-p-styrene-sulfonate | 50 mg/m$^2$ |
| Hardening Agent: 1,2-Bis(vinylsulfonyl-acetamido)ethane | 45 mg/m$^2$ |
| Emulsion Layer 2 | |
| Emulsion A | 4 g/m$^2$ as silver |
| Binder: Gelatin 2 (shown below) | 6.8 g/m$^2$ |
| Sensitizing Dye: Dye 1 (shown below) | 2.1 mg/lg-Ag (8.4 mg/m$^2$) |
| Additive: $C_{18}H_{35}O(CH_2CH_2O)_{20}H$ | 5.8 mg/lg-Ag |
| Trimethylolpropane | 420 mg/m$^2$ |
| Coating Aid: Potassium Poly-p-styrene sulfonate | 170 mg/m$^2$ |

Dye 1

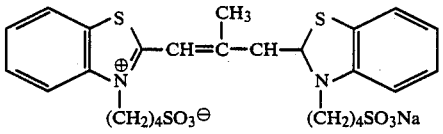

| | |
|---|---|
| Surface Protective Layer | |
| Binder: Gelatin 3 (shown below) | 0.7 g/m$^2$ |
| Coating Aid: N-Oleyl-N-methyltaurine Sodium Salt | 0.2 mg/m$^2$ |
| Matting Agent: Fine Polymethyl Methacrylate Particles (average particle size: 3 μm) | 0.13 mg/m$^2$ |

The gelatin used above is defined by the ratio of the gelatin's high molecular weight components as follows.

| Gelatin | High molecular weight Component Ratio* (weight %) |
|---|---|
| Gelatin 1 | 15.9% |
| Gelatin 2 | 4.1% |
| Gelatin 3 | 13.2% |

*The results were measured by the method described in JP-A-62-87952

(3) Sensitometry:

Each of the samples obtained was stored for 7 days following preparation thereof under the conditions of 25° C. and 65% relative humidity and then tested as follows:

(i) Wet Adhesive Test (Peeling test):

In a processing solution, two crossed scratches are formed on the photographic emulsion layer of each sample by scratching the layer using a stylus. The scratched portion is rubbed by finger tip in a direction perpendicular to the scratched line in each step of development, fixing, and washing.

A sample showing no peeling of the emulsion layer greater than that of the scratch is designated Grade A. A sample showing a maximum peeling width of 3 mm or less is designated Grade B. A sample which show peeling greater than 3 mm is designated Grade C.

(ii) Wet Scratching Test:

After dipping each sample in water of 25° C. for 3 minutes, the emulsion layer was scratched by a steel ball stylus while applying thereto a continuously changing load. The minimum weight of the load necessary for scratching the surface of the emulsion layer is identified.

(iii) Measurement of Sensitivity:

Each sample was exposed to a tungsten lamp of 400 lux through an optical wedge for 1/10 second and then developed by the developing solution shown below for 7 minutes at a 20° C. The sample was then fixed by the fixing solution shown below, washed and dried. On each sample thus processed, the relative sensitivity was measured in a relative of an exposure (E) that gives a constant density, Δlog E (an optical desity of 0.2) taking the relative sensitivity of Sample 1 as 100 (standard).

| Developing Solution | |
|---|---|
| Metol | 2 g |
| Sodium Sulfite | 100 g |
| Hydroquinone | 5 g |
| Borax.$10H_2O$ | 2 g |
| Water to make | 1 liter |
| Fixing solution | |
| The fixing solution employed is sold under the tradename Fuji Fix; made by the Fuji Photo Film Co., Ltd. | |

The results obtained are shown in Table 1 below together with the molecular weight and the amount of dextran added to respective layer.

TABLE 1

| | Average Molecular Weight (M.W.) and Amount of Dextran Added | | | | | | | | |
|---|---|---|---|---|---|---|---|---|---|
| Sample | Lowest Layer (Dry Thickness) | Binder Layer (Dry Thickness) | Inter Layer (Dry Thickness) | Emulsion Layer-1 (Dry Thickness) | Emulsion Layer-2 | Surface Protective Layer | Peeling Test | Scratching Test | Sensitivity |
| 1 (Comparison) | No Dextran (1 μm) | No Dextran (1.1 μm) | No Dextran (0.4 μm) | No Dextran (2.1 μm) | M.W.: 60,000 Amount: 2 g/m$^2$ | No Dextran | C | 62 g | 100 |
| 2 (Invention) | No Dextran (1 μm) | No Dextran (1.1 μm) | No Dextran (0.4 μm) | No Dextran (2.1 μm) | M.W.: 180,000 Amount: 2 g/m$^2$ | No Dextran | A | 60 | 100 |
| 3 (Comparison) | M.W.: 180,000 Amount: 0.5 g/m$^2$ (1 μm) | No Dextran (1.1 μm) | No Dextran (0.4 μm) | No Dextran (2.1 μm) | M.W.: 180,000 Amount: 1.5 g/m$^2$ | No Dextran | C | 60 | 85 |
| 4 (Invention) | No Dextran (1 μm) | M.W.: 180,000 Amount: 0.5 g/m$^2$ (1.1 μm) | No Dextran (0.4 μm) | No Dextran (2.1 μm) | M.W.: 180,000 Amount: 1.5 g/m$^2$ | No Dextran | B | 60 | 90 |
| 5 (Invention) | No Dextran (1 μm) | No Dextran (1.1 μm) | No Dextran (0.4 μm) | No Dextran (2.1 μm) | M.W.: 180,000 Amount: 2.8 g/m$^2$ | No Dextran | A | 54 | 105 |
| 6 (Invention) | No Dextran (1 μm) | No Dextran (1.1 μm) | No Dextran (0.4 μm) | No Dextran (2.1 μm) | M.W.: 100,000 Amount: 2 g/m$^2$ | No Dextran | B | 60 g | 100 |
| 7 (Invention) | No Dextran (1 μm) | No Dextran (1.1 μm) | No Dextran (0.4 μm) | No Dextran (2.1 μm) | M.W.: 120,000 Amount: 2 g/m$^2$ | No Dextran | A | 60 | 110 |
| 8 (Invention) | No Dextran (1 μm) | No Dextran (1.1 μm) | No Dextran (0.4 μm) | No Dextran (2.1 μm) | M.W.: 200,000 Amount: 2 g/m$^2$ | No Dextran | A | 56 | 95 |
| 9 (Invention) | No Dextran (1 μm) | No Dextran (1.1 μm) | No Dextran (0.4 μm) | No Dextran (2.1 μm) | M.W.: 300,000 Amount: 2 g/m$^2$ | No Dextran | A | 45 | 75 |
| 10 (Inven- | No Dextran (1 μm) | No Dextran (1.1 μm) | No Dextran (0.4 μm) | No Dextran (2.1 μm) | M.W.: 180,000 | M.W.: 180,000 | A | 60 | 105 |

TABLE 1-continued

| Sample | Average Molecular Weight (M.W.) and Amount of Dextran Added: Lowest Layer (Dry Thickness) | Binder Layer (Dry Thickness) | Inter Layer (Dry Thickness) | Emulsion Layer-1 (Dry Thickness) | Emulsion Layer-2 | Surface Protective Layer | Peeling Test | Scratching Test | Sensitivity |
|---|---|---|---|---|---|---|---|---|---|
| tion) | | | | | Amount: 1.7 g/m² | Amount: 0.3 g/m² | | | |
| 11 (Invention) | No Dextran (1 μm) | No Dextran (1.1 μm) | No Dextran (0.4 μm) | No Dextran (2.1 μm) | No Dextran | No Dextran | A | 78 | 48 |

Table 1 is explained by representing the following explanation of Comparative Sample 3.

For example, Comparative Sample 3 comprised a lowest layer having 0.5 g/m² of dextran of molecular weight 180,000 added therein; a binder layer, dry thickness of 1.1 μm having no added dextran; an interlayer of dry thickness of 0.4 μhaving no added dextran ; a first emulsion layer of dry thickness of 2.1 μm having no added dextran; a second emulsion layer having 1.5 g/m² of dextran of molecular weight 180,000 added therein; and surface protective layer having no added dextran. Comparative Sample 3 was rated as a C with respect to the peeling test. The Scratching Test yielding a threshold value of 60 grams and the sensitivity measured at 85.

It is clearly seen from the results shown in Table 1, that samples 2 and 4 to 10 (particularly samples 2, 5, 7, 8 and 10) of the present invention show good results in the peeling test and the scratching test as compared with the comparison samples.

Example 2

(1) Preparation of Tabular Grain Emulsion:

30 g of gelatin, 5 g of potassium bromide, and 0.05 g of potassium iodide were added to one liter of water in a vessel. While keeping this mixture at 75° C. , and aqueous silver nitrate solution (5 g as silver nitrate) and an aqueous potassium iodo bromide solution containing 0.15 g of potassium iodine were added thereto by a double jet method over a period of one minute. Furthermore, an aqueous silver nitrate solution (145 g as silver nitrate) and an aqueous solution of potassium bromide and potassium iodide were added thereto by a double jet method and thereafter the aqueous silver nitrate solution and an aqueous solution of potassium bromide were added to the mixture by a double jet method. In this case, the flow rate for the addition of the solutions was accelerated so that the flow rate immediately after finishing the addition was 10 times faster than at the initiation of the addition. Thereafter, soluble salts were removed by a flocculation method (sedimentation method) at 35° C. After increasing the temperature thereof to 45° C., 75 g of gelatin was added. The pH was then adjusted to 6.4.

The emulsion obtained was a tabular grain silver halide emulsion composed of tabular silver halide grains having an average iodine content of 8 mol %, an average projected area diameter of 2.4 μm, and an average thickness of 0.17 μm. Also, the distribution of the projected area diameter had a relatively narrow coefficient of variation of 19%.

After adding a sensitizing dye to the emulsion, the emulsion was subjected to a gold and sulfur sensitization to provide Emulsion D.

(2) Preparation of Coated Samples:

Each of the coated samples having the following layers was prepared.

The lowermost layer, the binder layer, the interlayer, and the surface protective layer of each sample were the same as provided in Example 1.

| | |
|---|---|
| Emulsion Layer 1 | |
| Emulsion C (see Example 1) | 1.5 g/m² as silver |
| Binder: Delatin 2 (See Example 1) | 2 g/m² |
| Sensitizing Dye: Dye 1 (See Example 1) | 2.1 mg/1 g-Ag |
| Additive: $C_{18}H_{35}O\text{-}(CH_2CH_2O)_{20}\text{-}H$ | 5.8 mg/1 g-Ag |
| Coating Aid: Potassium Poly-p-styrenesulfonate | 50 mg/m² |
| Hardening Agent: 1,2-bis(vinylacetoamido)ethane | 45 mg/m² |
| Emulsion Layer 2 | |
| Emulsion D | 4 g/m² as silver |
| Binder: Gelatin 2 (see Example 1) | 6.8 g/m² |
| Sensitizing Dye: Dye 2 (See Example 1) | 4.2 mg/1 g-Ag |
| Additive: $C_{18}H_{35}O\text{-}(CH_2CH_2O)_{20}\text{-}H$ | 5.8 mg/1 g-Ag |
| Trimethylolpropane | 420 mg/m² |
| Coating Aid: Potassium Poly-p-styrenesulfonate | 170 mg/m² |

(3) Sensitoeter:

The sensitometric test was performed on each sample by the same manner as in Example 1 and the results obtained are shown in Table 2 below together with the molecular weight and the amount of dextran added to respective layer.

TABLE 2

| Sample | Average Molecular Weight (M.W.) and Amount of Dextran Added: Lowest Layer (Dry Thickness) | Binder Layer (Dry Thickness) | Inter Layer | Emulsion Layer-1 | Emulsion Layer 2 | Surface Protective Layer | Peeling Test | Scratching Test | Sensitivity |
|---|---|---|---|---|---|---|---|---|---|
| 12 (Comparison) | No Dextran (1 μm) | No Dextran (1.1 μm) | No Dextran | No Dextran | No Dextran | No Dextran | A | 70 | 100 |
| 13 (Comparison) | No Dextran (1 μm) | No Dextran (1.1 μm) | No Dextran | No Dextran | M.W.: 60,000 Amount: 2 g/m² | No Dextran | C | 46 | 210 |

TABLE 2-continued

| Sample | Average Molecular Weight (M.W.) and Amount of Dextran Added: Lowest Layer (Dry Thickness) | Binder Layer (Dry Thickness) | Inter Layer | Emulsion Layer-1 | Emulsion Layer 2 | Surface Protective Layer | Peeling Test | Scratching Test | Sensitivity |
|---|---|---|---|---|---|---|---|---|---|
| 14 (Invention) | No Dextran (1 μm) | No Dextran (1.1 μm) | No Dextran | No Dextran | M.W.: 180,000 Amount: 2 g/m$^2$ | No Dextran | A | 46 | 210 |
| 15 (Comparison) | M.W.: 180,000 Amount: 0.5 g/m$^2$ (1 μm) | No Dextran (1.1 μm) | No Dextran | No Dextran | M.W.: 180,000 Amount: 1.5 g/m$^2$ | No Dextran | C | 46 | 200 |
| 16 (Invention) | No Dextran (1 μm) | M.W.: 180,000 Amount: 0.5 g/m$^2$ (1.1 μm) | No Dextran | No Dextran | M.W.: 180,000 Amount: 1.5 g/m$^2$ | No Dextran | B | 46 | 203 |

It is clearly seen from the results shown in Table 2 that samples 14 and 16 of the present invention show good results in the peeling test and the scratching test and have high sensitivity as compared with the comparative samples lacking the construction of the present invention.

Example 3

(1) Preparation of Light-Sensitive Silver Halide Emulsion:

Emulsion A was prepared by the same procedure as in Example 1.

(2) Preparation of Coated Samples:

Samples 17 to 26 were prepared by forming the following layers on a triacetyl cellulose film support.

| | |
|---|---|
| Binder Layer | |
| Binder: Gelatin 1 (see Example 1) | Dry thickness shown in Table 3 below |
| Coating Aid: Potassium Poly-p-styrenesulfonate | 10.0 mg/m$^2$ |
| Emulsion Layer | |
| Emulsion A | 4 g/m$^2$ as Ag |
| Binder: Gelatin 2 | 6.8 g/m$^2$ |
| Sensitizing Dye: Dye 1 (see Example 1) | 2.1 mg/1 g-Ag |
| Additive: $C_{18}H_{35}O(CH_2CH_2O)_{20}H$ | 5.8 mg/1 g-Ag |
| Trimethylolpropane | 420 mg/m$^2$ |

-continued

| | |
|---|---|
| Coating Aid: Potassium Poly-p-styrenesulfonate | 170 mg/m$^2$ |
| Hardening Agent: 1,2-Bis(vinylsulfonyl-acetamido)-ethane | 45 mg/m$^2$ |

Surface Pritective Layer

Same as in Example 1

In this example two different layer structures are employed.

| Layer Structure: Structure A | Structure B |
|---|---|
| Surface Protective Layer | Surface Protective Layer |
| Emulsion Layer | Binder Layer |
| Binder Layer | Emulsion Layer |
| Support | Support |

(3) Sensitometry:

The sensitometric test was perfomed in the same manner as in Example 1.

The results obtained are shown in Table 3 below together with the molecular weight and the amount of dextran added to the emulsion layer.

TABLE 3

| Sample | Layer Structure | Binder Layer (Dry Thickness) | Emulsion Layer: Molecular Weight of Dextran | Emulsion Layer: Amount of Dextran Added | Peeling Test | Sensitivity |
|---|---|---|---|---|---|---|
| 17 (Comparison) | A | 0.2 μm | 160,000 | 1.5 g/m$^2$ | C | 100 |
| 18 (Comparison) | A | 0.6 μm | " | " | C | 100 |
| 19 (Invention) | A | 1.0 μm | " | " | A | 100 |
| 20 (Invention) | A | 1.4 μm | " | " | A | 100 |
| 21 (Invention) | A | 1.8 μm | " | " | A | 100 |
| 22 (Comparison) | A | 1.8 μm | 40,000 | " | C | 102 |
| 23 (Comparison) | A | " | 80,000 | " | C | 100 |
| 24 (Invention) | A | " | 120,000 | " | A | 100 |
| 25 (Comparison) | B | " | 160,000 | " | C | 100 |
| 26 (Comparison) | A | " | No Dextran | No Dextran | A | 42 |

It is clearly seen from the results shown in Table 3 above that samples of the present invention show good results in the peeling test and have high sensitivity as compared with comparative samples 17 and 18 having a binder layer dry thickness thinner than that of the binder layer thickness defined in the present invention; comparative samples 23 and 24 containing dextran having a molecular weight lower than that defined in the present invention; and comparative samples 25 and 26 having the layer structure B or which do not contain dextran.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having on one side of the support a subbing layer, and at least two hydrophilic colloid layers, at least one of said hydrophilic colloid layers containing dextran having an average molecular weight of at least 100,000, wherein at least one hydrophilic colloid layer containing substantially no dextran and having a dry thickness of at 1.0 μm exits between (1) the hydrophilic colloid layer containing the dextran disposed nearest to the support and (2) the subbing layer.

2. The silver halide photographic material as claimed in claim 1, wherein the hydrophilic colloid layer containing substantially no dextran is a light-insensitive hydrophilic colloid layer. the hydrophilic colloid layer containing the dextran is a light-sensitive silver halide emulsion layer, and the photographic material further has a surface protective layer as the uppermost layer and a backing layer at the opposite side of the support to the side on which said silver halide emulsion layer is present.

3. The silver halide photographic material as claimed in claim 1, wherein the hydrophilic colloid layer containing substantially no dextran is composed of plural light-insensitive hydrophilic colloid layers, the hydrophilic colloid layer containing the dextran are plural light-sensitive silver halide emulsion layer, and the photographic material futher has a surface protective layer as the uppermost layer and a backing layer at the opposite side of the support to the side on which said silver halide emulsion layer is present.

4. The silver halide photographic material as claimed in claim 1, wherein the hydrophilic coloid layer containing substantially no dextran is a light insensitive hydrophilic collid layer, the hydrophilic colloid layer containing the dextran is composed of a light-insensitive hydrophilic colloid layer containing the dextran and plural light-sensitive silver halide emulsion layers containing the dextran, and the photographic material further has a surface protective layer as the uppermost layer and a backing layer at the opposite side of the support to the side on which said silver halide emulsion layer is present.

5. The silver halide photographic material as claimed in claim 1, wherein the support has a subbing layer on each side thereof and has the hydrophilic colloid layer containing substantially no dextran and at least one hydrophilic colloid layer containing the dextran on both sides of the support.

6. The silver halide photographic material as claimed in claim 1, wherein the hydrophilic colloid layer containing substantially no dextran is a light-sensitive emulsion layer, the hydrophilic colloid layer containing the dextran is a light-sensitive silver halide emulsion layer, and the photographic material further has a surface protective layer as the uppermost layer and a backing layer at the oppostive side of the support to the side on which said silver halide emulsion layer in present.

7. The silver halide photographic material as claimed in claim 1, wherein the hydrophilic colloid layer containing substantially no dextran contains no silver halide photographic emulsion.

8. The silver halide photographic material as claimed in claim 1, wherein the dextran which is contained in the hydrophilic colloid layer containing the dextran is incorporated in a photographic emulsion layer.

9. The silver halide photographic material as claimed in claim 1 wherein the average molecular weight of the dextran is from 120,000 to 200,000.

10. The silver halide photographic material as claimed in claim 1, wherein the dry thickness of the hydrophilic colloid layer containing substantially no dextran is from 1.0 to 5.0 μm.

11. The silver halide photographic material as claimed in claim 1, wherein the hydrophilic colloid layer containing substantially no dextran is disposed adjacent said subbing layer for the support.

* * * * *

UNITED STATES PATENT AND TRADEMARK OFFICE

CERTIFICATE OF CORRECTION

PATENT NO. : 4,916,049

DATED : April 10, 1990

INVENTOR(S) : Ichizo Toya

It is certified that error appears in the above-identified patent and that said Letters Patent is hereby corrected as shown below:

Column 15, line 25:

Claim 1, line 8, delete "exits" and insert --exists--.

Signed and Sealed this

Twenty-fifth Day of February, 1992

*Attest:*

HARRY F. MANBECK, JR.

*Attesting Officer*

*Commissioner of Patents and Trademarks*